US007300180B2

(12) United States Patent
Hutchison et al.

(10) Patent No.: US 7,300,180 B2
(45) Date of Patent: Nov. 27, 2007

(54) LIGHTING ASSEMBLY WITH RELEASABLY ATTACHABLE LAMP AND COMPONENT HOUSINGS

(75) Inventors: Joseph A. Hutchison, Dallas, TX (US); David L. White, Grapevine, TX (US)

(73) Assignee: P. L. Systems, Inc., Dallas, TX (US)

( * ) Notice: Subject to any disclaimer, the term of this patent is extended or adjusted under 35 U.S.C. 154(b) by 165 days.

(21) Appl. No.: 11/107,425

(22) Filed: Apr. 15, 2005

(65) Prior Publication Data

US 2006/0232959 A1 Oct. 19, 2006

(51) Int. Cl.
*F21V 21/00* (2006.01)

(52) U.S. Cl. ..... 362/265; 362/221; 362/225; 362/295; 362/368; 362/657; 362/251

(58) Field of Classification Search ..... 362/260, 362/265, 217, 221, 225, 368, 647, 648, 404, 362/652, 295, 251, 657, 659
See application file for complete search history.

(56) References Cited

U.S. PATENT DOCUMENTS 5,138,528 A * 8/1992 Altman et al. ..... 361/760
5,394,315 A 2/1995 Ahroni
5,720,546 A * 2/1998 Correll et al. ..... 362/221
6,079,851 A * 6/2000 Altman et al. ..... 362/260
6,394,869 B1 * 5/2002 Haugaard et al. ..... 445/23
6,461,025 B1 10/2002 Payne
6,877,884 B2 4/2005 Wu
6,979,097 B2 * 12/2005 Elam et al. ..... 362/148
7,137,724 B2 * 11/2006 Menze et al. ..... 362/543

* cited by examiner

*Primary Examiner*—Thomas M. Sember
(74) *Attorney, Agent, or Firm*—Crutsinger & Booth, LLC

(57) ABSTRACT

A lighting assembly with a lamp housing and a component housing which have corresponding mechanical connectors for releasably attaching the housings to one another and which have corresponding electrical connectors for releasably providing electrical connection between the housings. The lamp housing has a lamp frame, at least one lamp socket for receiving at least one lamp and lamp wiring for supplying power to the at least one lamp. The lamp housing has an electrical connector operably attached to the lamp wiring. The lamp housing further has a mechanical connector. Mounted to the component housing are electrical control components, electrical ballast and a power supply socket. The component housing has an electrical connector operable to releasably connect with the electrical connector of the lamp housing. The component housing has a mechanical connector operable to releasably attach to the mechanical connector of the lamp housing.

19 Claims, 10 Drawing Sheets

LIGHTING ASSEMBLY WITH RELEASABLY ATTACHABLE LAMP AND COMPONENT HOUSINGS

CROSS-REFERENCE TO RELATED APPLICATION

None

STATEMENT REGARDING FEDERALLY SPONSORED RESEARCH OR DEVELOPMENT

None

REFERENCE TO MICROFICHE APPENDIX

Not applicable

TECHNICAL FIELD

The present invention relates generally to a lighting assembly. More specifically, the present invention relates to a lighting assembly having a lamp housing and a component housing which are mechanically and electrically releasably connected.

BACKGROUND

Typically, light assemblies include electrical ballast, electrical control gear and a lamp (or lamps). The ballast and control components are not located in a housing which is easily separable from a lamp housing. Thus, when a light assembly breaks or ceases working, the user or an electrician must disassemble the light assembly and replace the broken components, such as an electrical filter, a control switch or the ballast, individually. The process is time consuming and requires an expert since wiring configurations vary depending on the type of ballast and controls. Repair and replacement of ballast components is complicated by the fact that ballast manufacturers' products are sometimes wired differently.

Lighting assemblies are provided in various configurations. For example, a lighting assembly may have a standard ballast with instant start, 20% THD maximum, running on 120 Volts. Various configurations run on 120, 240 or 277 Volts, or may be a euro configuration running on 0.50 Hertz. The THD maximums are variable from configuration to configuration, for example, at 2%, 10% or 20% maximum THD. Configurations may also include dimmer controls, which may be analog voltage controlled or digitally controlled dimmers or ballasts. Currently, changing a lighting assembly configuration is complicated and typically requires an electrician. For example, changing from a non-dimming lighting arrangement to a dimming arrangement requires wiring dimming controls into the lighting assembly. Changing the dimming controls requires removing the installed dimmer and re-wiring a new dimmer and/or changing the lamp wiring. Any change in dimming arrangement, from analog to digital, for example, requires similar re-wiring.

Suppliers of lighting assemblies are required to repair or change each assembly on-site or must have the entire lighting assembly, including the lamp frame, shipped for repair or replacement. Shipping of the entire lighting assembly is costly and time consuming. Further, suppliers are required to purchase parts in lots, maintain stocks and then assemble the parts in response to customer orders. Again, re-wiring and replacement of parts is time-consuming and costly.

A need exists for a lighting assembly which allows for easily and quickly replacing broken or non-functioning electrical components. A need also exists for easily and quickly changing the lighting configuration of a lighting assembly. A need exists for reducing the time necessary to respond to repair and replacement orders and to reduce shipping costs and times.

SUMMARY OF THE INVENTION

A lighting assembly is provided which has a lamp housing and a separate component housing. The assembly has a lamp housing and a component housing with corresponding mechanical connectors for releasably attaching the housings to one another and with corresponding electrical connectors for releasably providing electrical connection between the housings.

The lamp housing has a lamp frame, at least one lamp socket for receiving at least one lamp and lamp wiring for supplying power to the at least one lamp. The lamp housing has an electrical connector operably attached to the lamp wiring. The lamp housing further has a mechanical connector.

Mounted to the component housing are electrical control components, electrical ballast and a power supply socket. The component housing has an electrical connector operable to releasably connect with the electrical connector of the lamp housing. The component housing has a mechanical connector operable to releasably attach to the mechanical connector of the lamp housing.

The electrical connectors are preferably quick-snap, nine pin connectors. Such an arrangement allows for ease of connection and a single arrangement can be used for both single and dual lamp housings.

The mechanical connectors comprise corresponding mountings. In one embodiment, the corresponding mountings include mating screw and nut assemblies. Hence, the component housing can simply be screwed onto the lamp housing.

The electrical control components of the component housing can include dimmer controls and dimmer circuitry for selectively dimming the lamps of the lamp housing. The dimmer controls and circuitry can be analog or digital. The electrical components can run on any selected voltage and can be AC or DC. The electrical components can include a power output socket and a power switch for selectively supplying power to a lamp in the lamp housing. The components can further include a computer board and computer components for controlling the functions of the component and lamp housings.

The lamp housing can provide a single or multiple lamps, various reflectors and lenses, as desired.

It is an object of this invention to provide for a lighting assembly which allows for easily and quickly replacing broken or non-functioning electrical components, preferably without need for re-wiring of the lighting assembly on-site or shipment of the entire lighting assembly. It is a further object of this invention to provide for easily and quickly changing the lighting configuration of a lighting assembly. It is a further object of this invention to provide for reducing the time necessary to respond to repair and replacement orders and to reduce shipping costs and times related to lighting assemblies.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such constructions do not depart from the spirit and scope of the invention as set forth in the appended claims.

BRIEF DESCRIPTION OF THE DRAWINGS

The accompanying drawings are incorporated and form a part of the specification to provide illustrative examples of the present invention. These drawings together with the description serve to explain the principles of the invention. The drawings are only for purposes of illustrating preferred and alternate embodiments of how the invention can be made and used and are not to be construed as limiting the invention to only the illustrated and described examples. Various advantages and features of the present invention will be apparent from consideration of the accompanying drawings. For a more complete understanding of the present invention, and the advantages thereof, reference is now made to the following drawings, in which.

DETAILED DESCRIPTION OF ILLUSTRATIVE EMBODIMENTS

Figure 1:
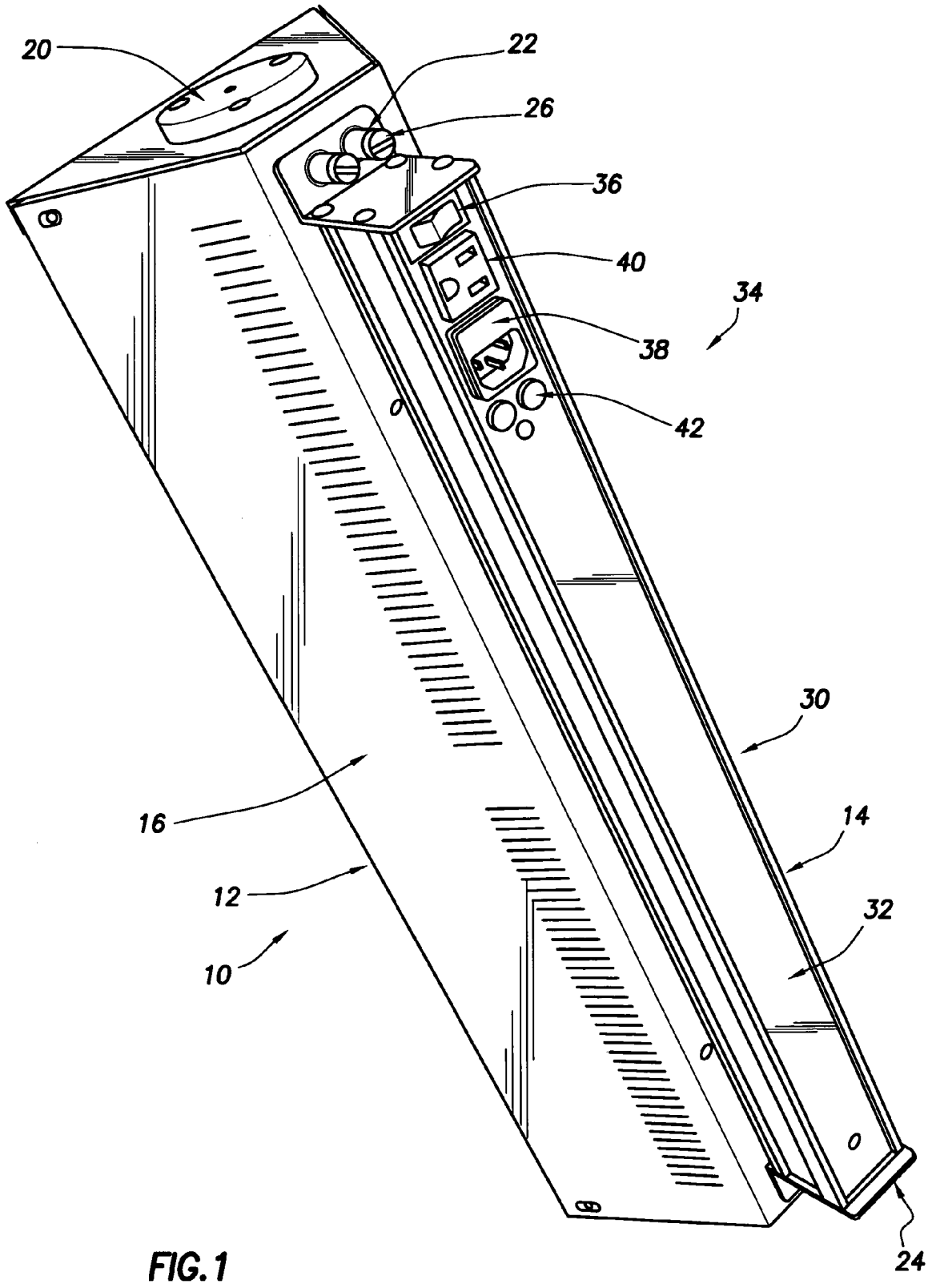
FIG. 1 is an orthogonal rear view of a fluorescent lighting assembly 10 of the invention.

The present invention will be described by referring to drawings of examples of how the invention can be made and used. Like reference characters are used throughout the several figures of the drawing to indicate like or corresponding parts.

Referring to FIG. 1, an orthogonal view of a fluorescent lighting assembly 10 is shown, from the rear, having a lamp housing 12 and a component housing 14. The lamp housing 12 has a lamp housing frame 16 which houses the lamp members. The lamp frame 16 preferably includes a lamp frame mounting 20 for mounting the lamp housing to a lighting framework (not shown). The presented mounting 20 allows for pivotal movement of the lamp frame to a lampholder.

Attached to the lamp housing 12 is the component housing 14. The component housing 14 is removably attached to the lamp housing 12 at control housing mountings 22. The mountings 22 are part of the end plates 24 and include, in this embodiment, multiple fasteners 26, in this case screws, which cooperate with corresponding fastener receivers 28, in this case nuts, in the lamp housing, seen in FIG. 3. The screw and nut assemblies may be replaced with any fastener 26 or attachment assembly. The purpose is to provide easy removal of the component housing from the lamp housing while still providing stable attachment during use. The fastener assemblies 26 may include snap-on assemblies, screws, clips, latches and other releasable fasteners known in the art.

The component housing 14 includes a housing box 30 which slidably cooperates with component plate 32 and is attached by screws to end plates 24. The component housing may be of other construction, may include more or fewer parts and be attached by other means. For example, the component housing in FIG. 8 does not include end plates. Other constructions will be readily apparent to those of skill in the art. The component housing should be removable from the lamp housing as a single unit, however, for ease of removal and replacement. The component housing can also provide a surface for informational displays, as shown.

Figure 8:
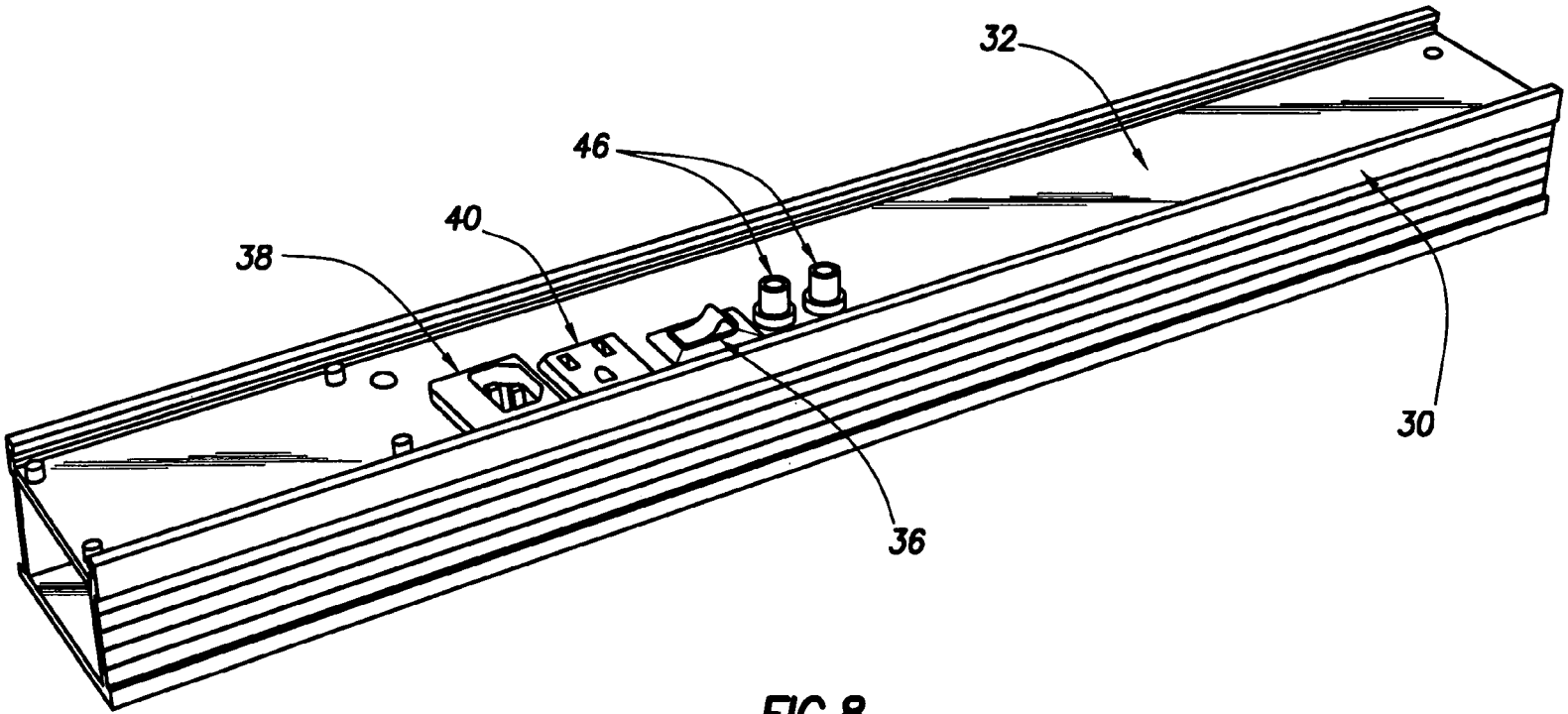
FIG. 8 is an orthogonal view of an alternate embodiment of a component housing.
Figure 11:
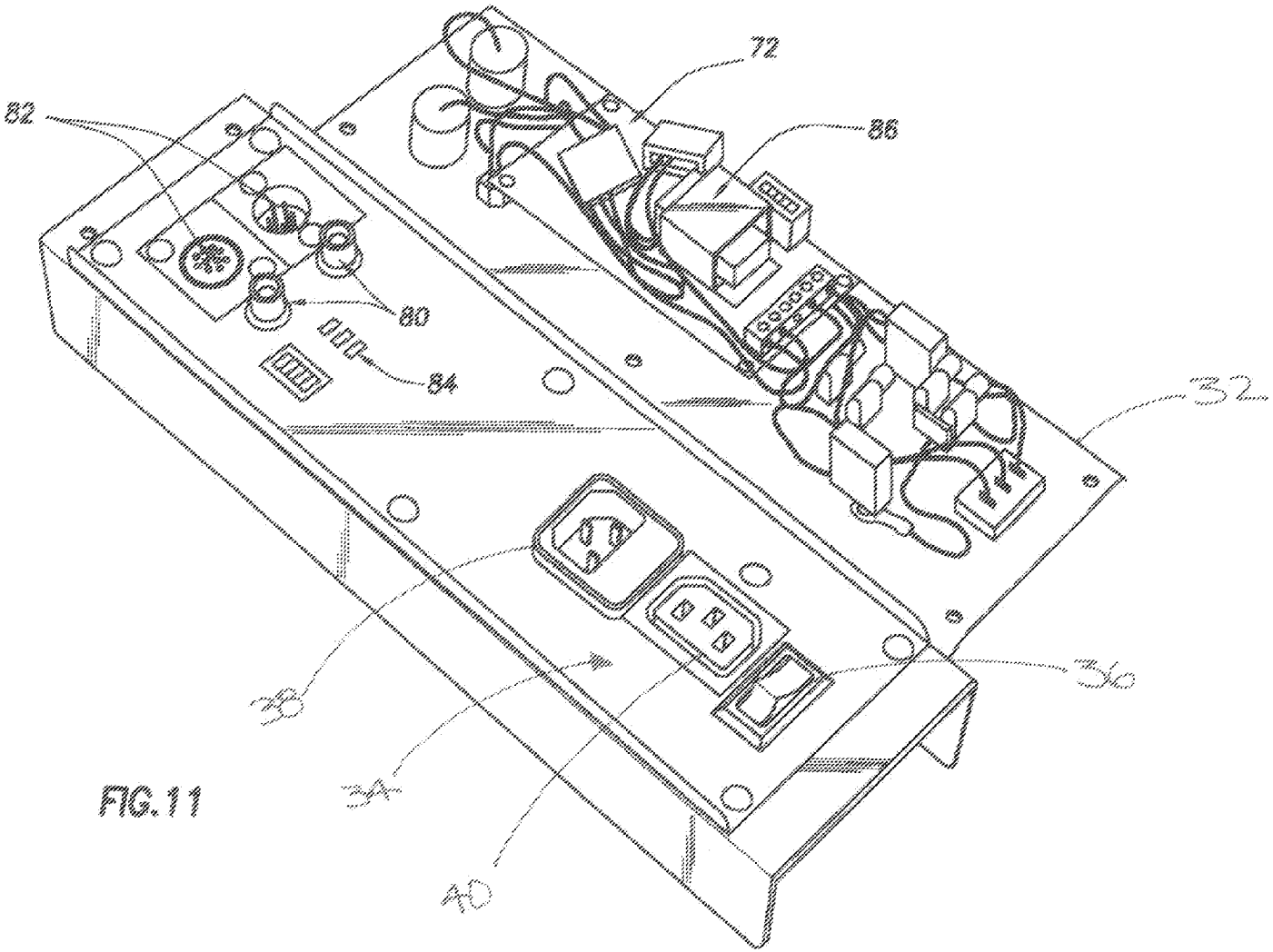
FIG. 11 is an orthogonal view of an alternative embodiment of the invention.

The power supply component housing 14 includes electrical control components 34 which can include power switches 36, power supply input sockets 38 and power output sockets 40. The control components 34 can further include controls such as analog or digital dimmer control 42, such as represented by a dummy control 42 in FIG. 4, and other input, output and control devices as are known in the art. FIG. 8 shows one alternate embodiment having alternate input and output controls 46. FIG. 11 shows at alternate embodiment having controls 34 including power switch 36, power input socket 38, power output socket 40, analog input and output sockets 80, digital input and output sockets 82, and a channel selector 84.

Figure 2:
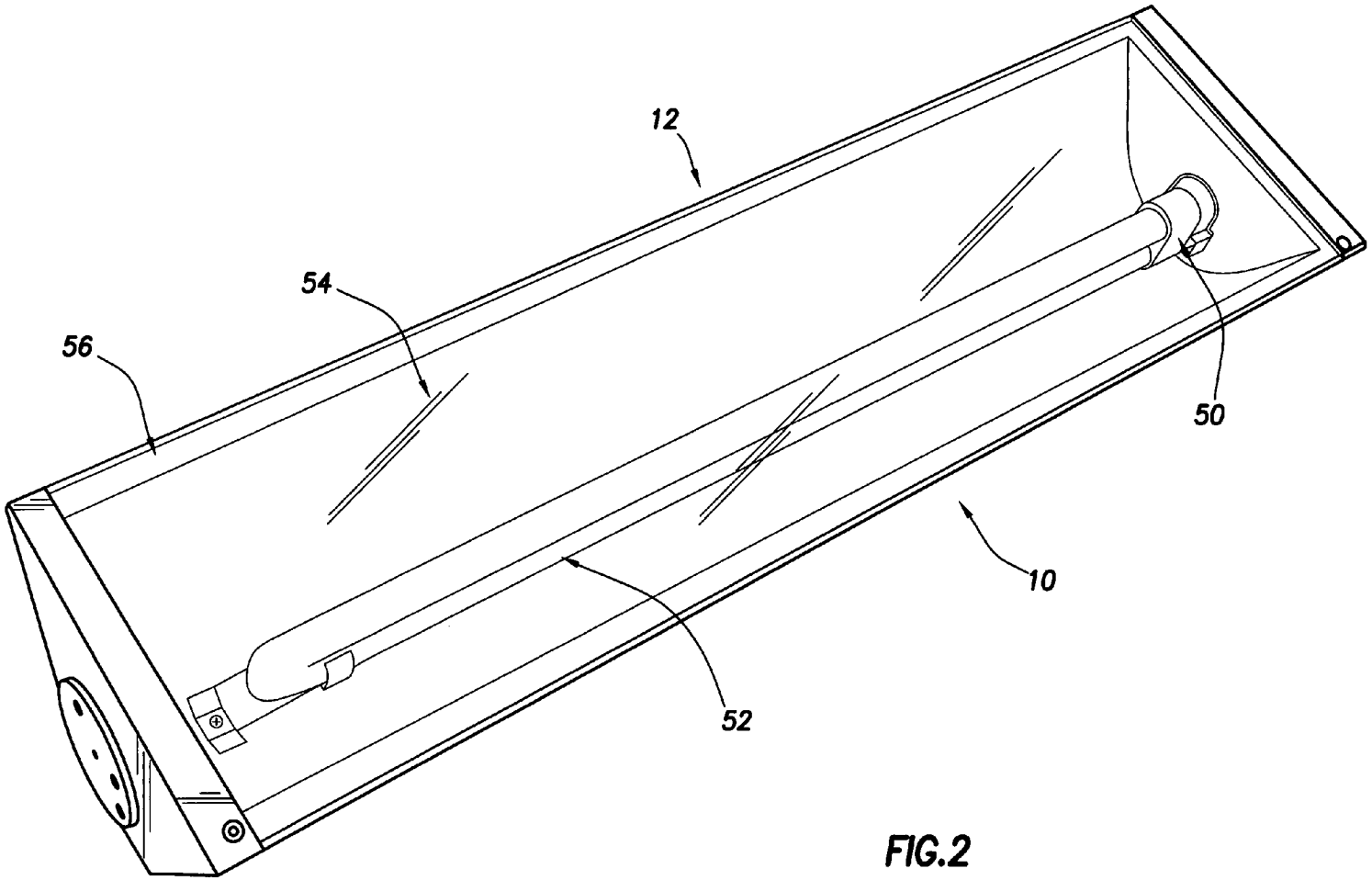
FIG. 2 is an orthogonal view of the front of the lighting assembly.

FIG. 2 is an orthogonal view of the front of the lighting assembly 10. The lamp housing 12 includes, preferably, one or more lamp sockets 50 for attachment to one or more lamps 52. The lamp housing may also include reflective surfaces 54 and lenses 56, as desired, and as known in the art. The reflective surfaces may be smooth or faceted, specular or semi-specular or diffusing. The optional lenses 56 may be of any kind known in the art, including, fresnel, prismatic, neutral or colored film, egg crate, honeycomb or clear.

Figure 3:
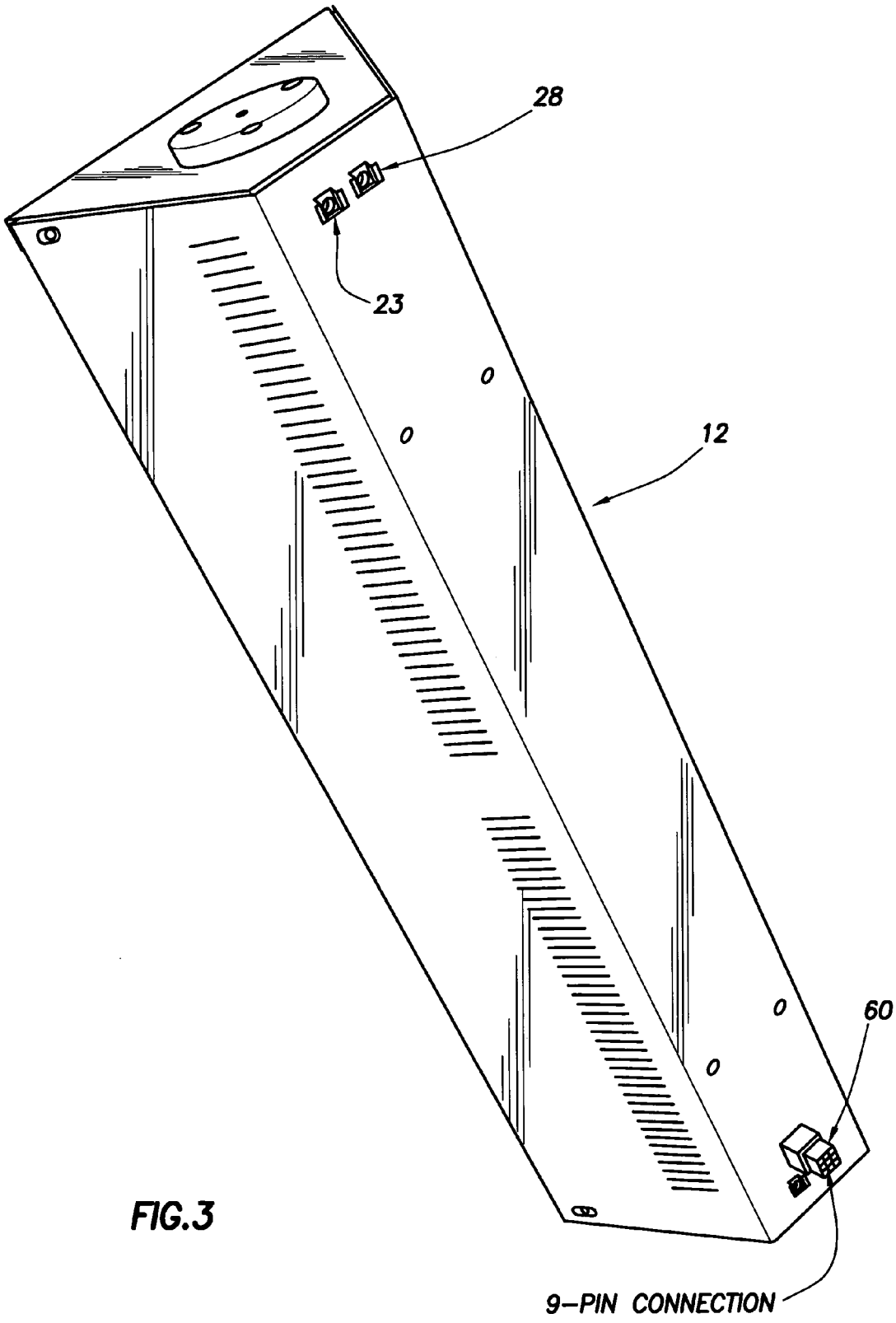
FIG. 3 is an orthogonal rear view of a lamp housing detached from the component housing.

FIG. 3 shows a lamp housing 12 detached from the component housing 14. The lamp housing 12 includes an electrical connector 60 to provide electrical connection to a corresponding connector on the component housing. The electrical connector may be of any kind known in the art, AMP Mini Mate-N-Lok® brand connector as shown, or other electrical connectors. Preferably the connector is a nine-pin connector, as shown, although other connectors may be used. The nine-pin connector enables connection for two of most high-grade fluorescent lights, which typically require four connections each, plus a single ground connection.

Also seen in FIG. 3 is the mounting 23 corresponding to the component housing mounting 22. The preferred mounting 23 includes fastener receivers 28, such as the nut assemblies shown. The nut assemblies receive the screw fasteners 26 seen in FIG. 1. The nut assemblies shown are mounted to the lamp housing frame such that they slide longitudinally along the frame. This allows for greater tolerances in manufacture and attachment of the component housing to the lamp housing.

Figure 4:
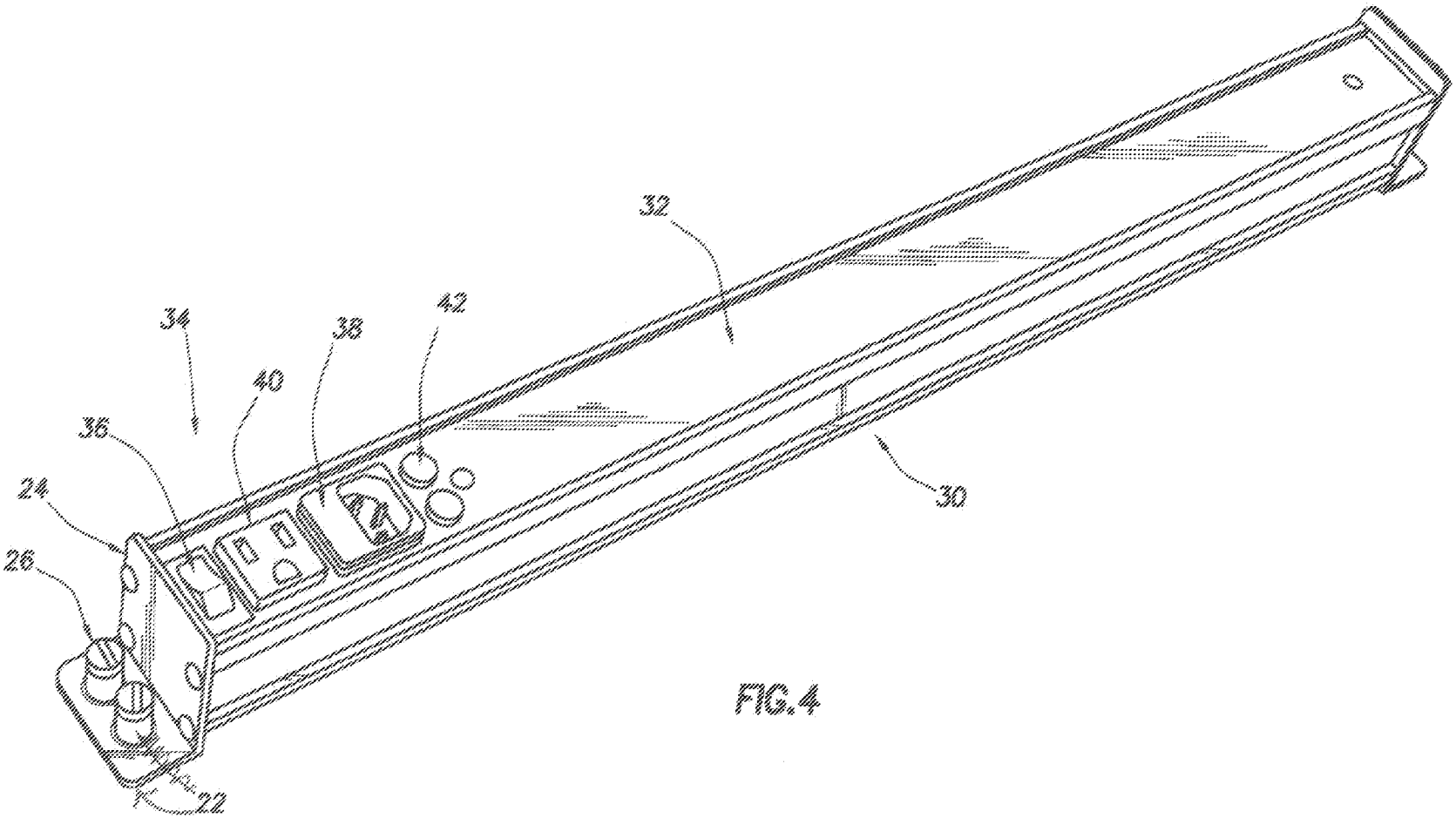
FIG. 4 is an orthogonal view of the rear of the component housing.

FIG. 4 presents an orthogonal view of the component housing 14, housing box 30, component plate 32 and controls 34, such as switch 36, sockets 38 and 40, and other controls 42. Also seen in this Figure are optional springs for biasing screw fasteners 26.

Figure 5:
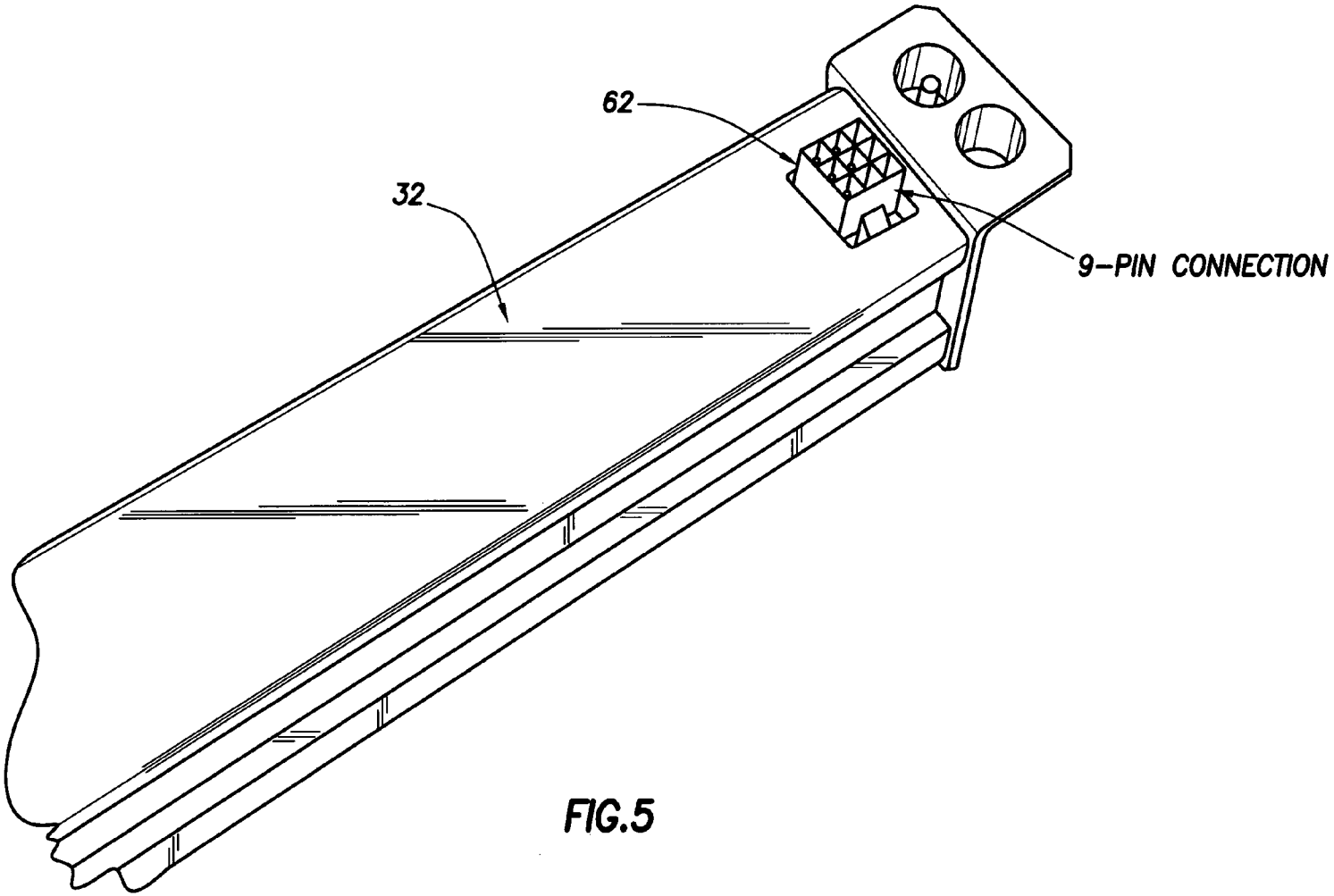
FIG. 5 is an enlarged detail view of the front of the component housing.

FIG. 5 is an enlarged detail view of the component housing 14 showing the side of the component housing 14 which faces the lamp housing 12 when the housings are assembled together. Component housing box 30 is seen with an opening for electrical connector 62. Electrical connector 62 cooperates with connector 60 of the lamp housing, as explained above. Again, the connector 62 is preferably a quick snap connector, although other types may be used. The electrical connector 62 is preferably a nine-pin connector, for reasons explained above, but may be of different design, as desired.

Figure 6:
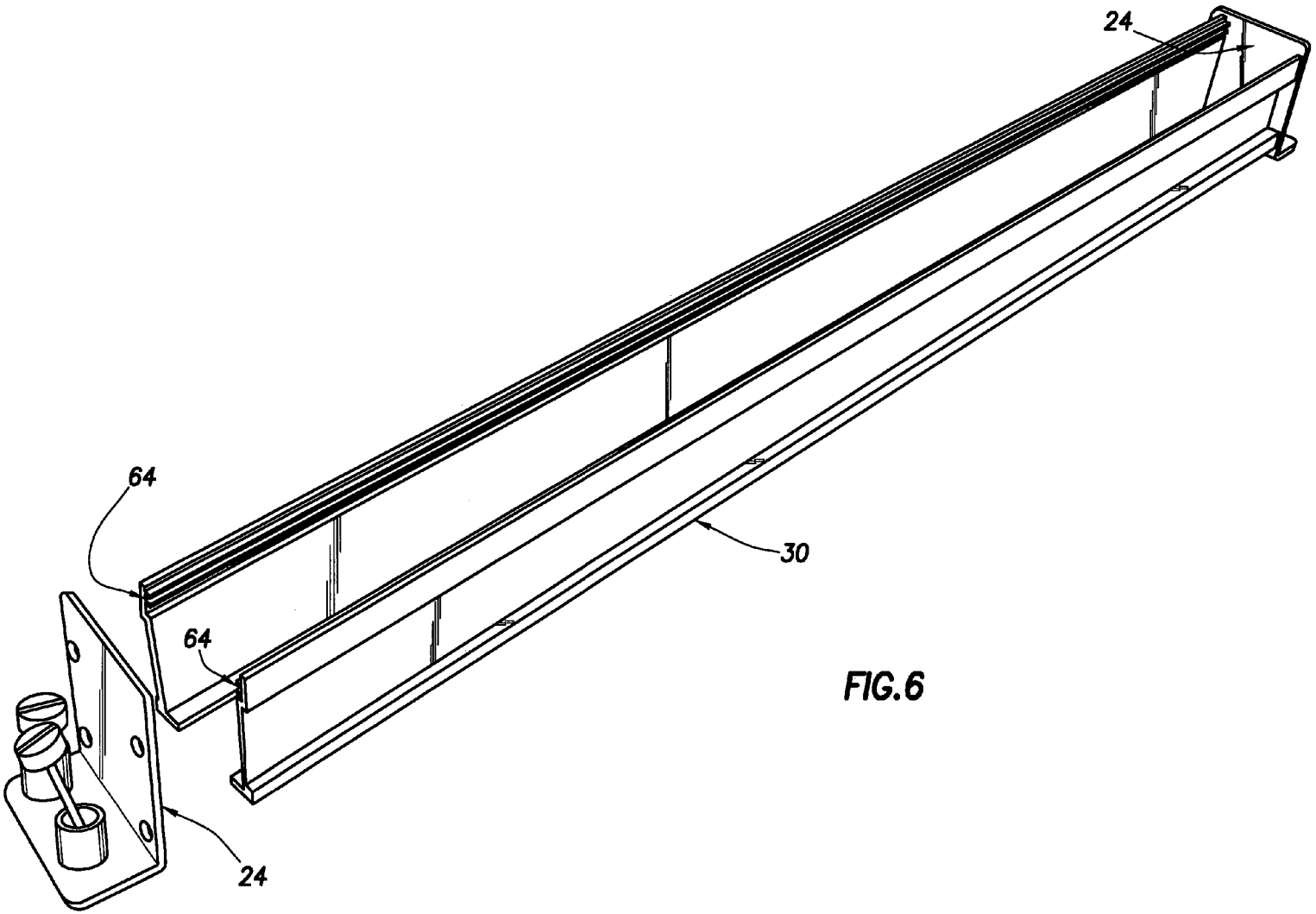
FIG. 6 is an orthogonal view of the housing box.

FIG. 6 is an orthogonal view of the housing box 30 with the component plate 32 removed. One end plate 24 is also detached for illustrative purposes. The housing box may be assembled in various configurations without departing from the spirit of the invention. In the embodiment shown, the housing box 30 has component plate slots 64 which cooperate with the component plate 32 to allow the component plate 32 to slidably attach to the housing box 30.

Figure 7:
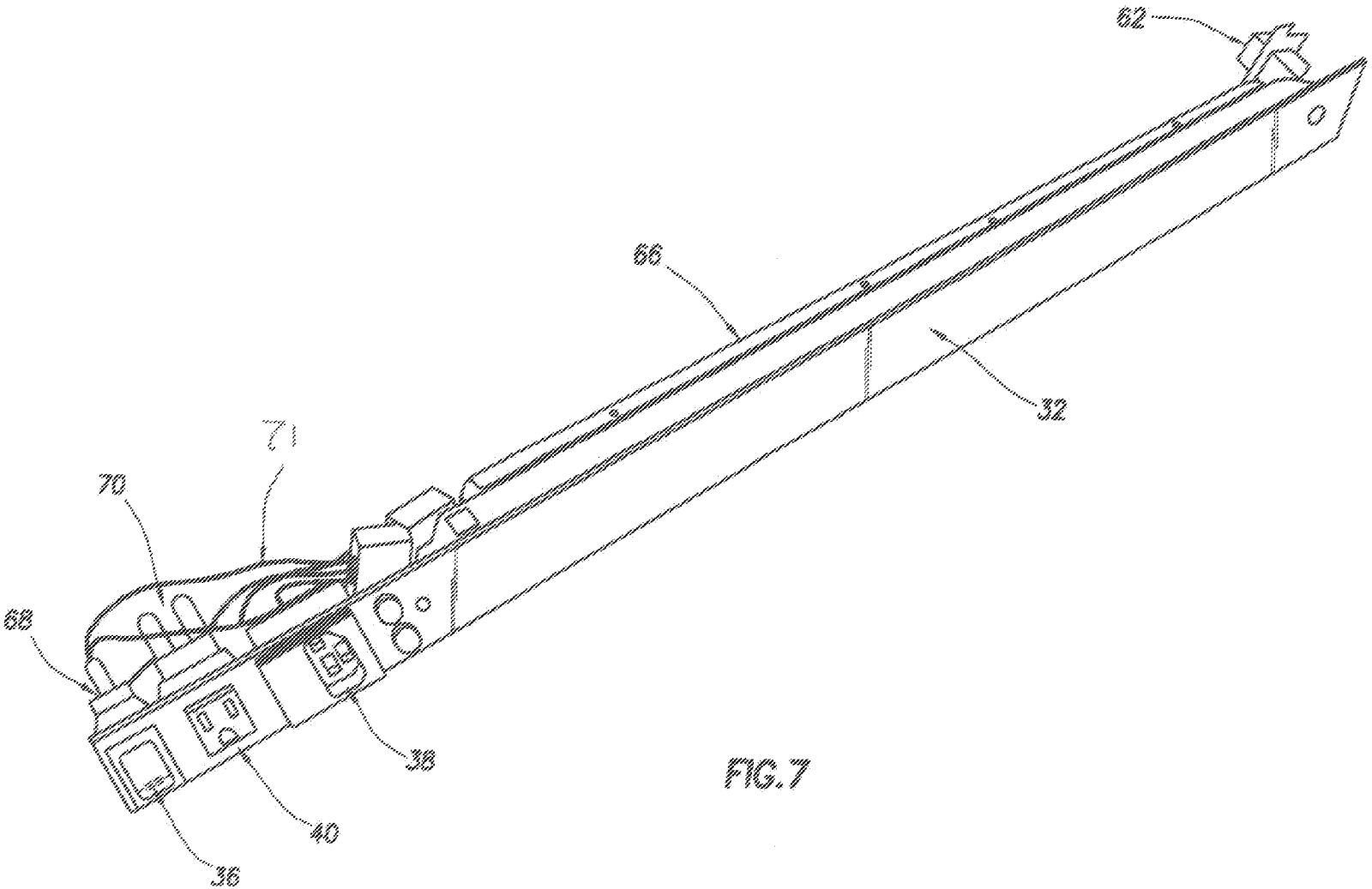
FIG. 7 is an orthogonal view of the component plate.
Figure 10:
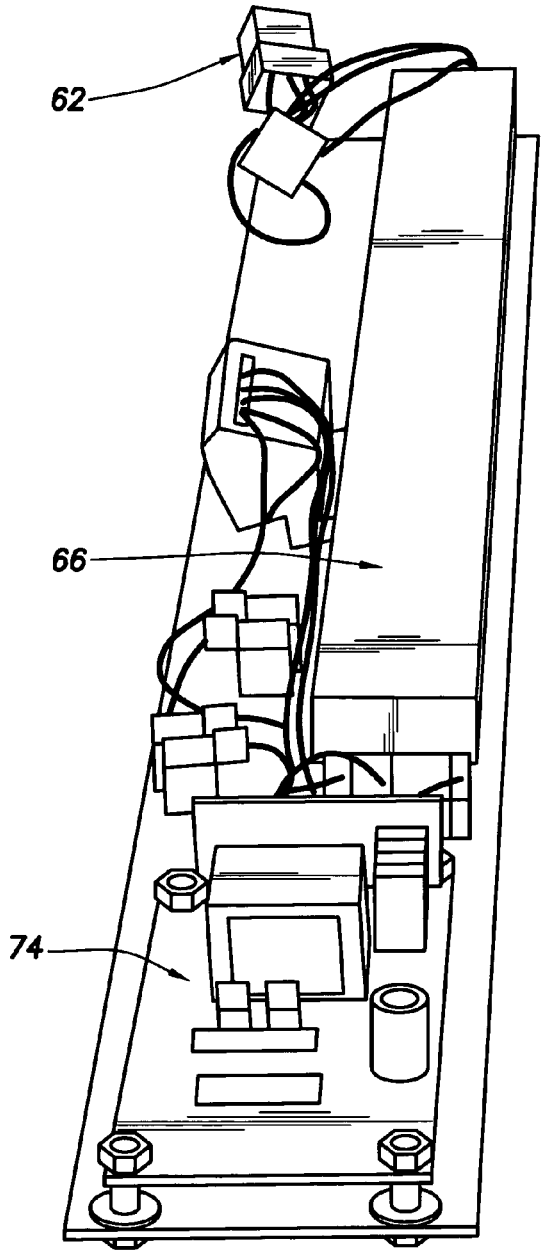
FIG. 10 is an end view of the component plate of FIG. 8.
Figure 9:
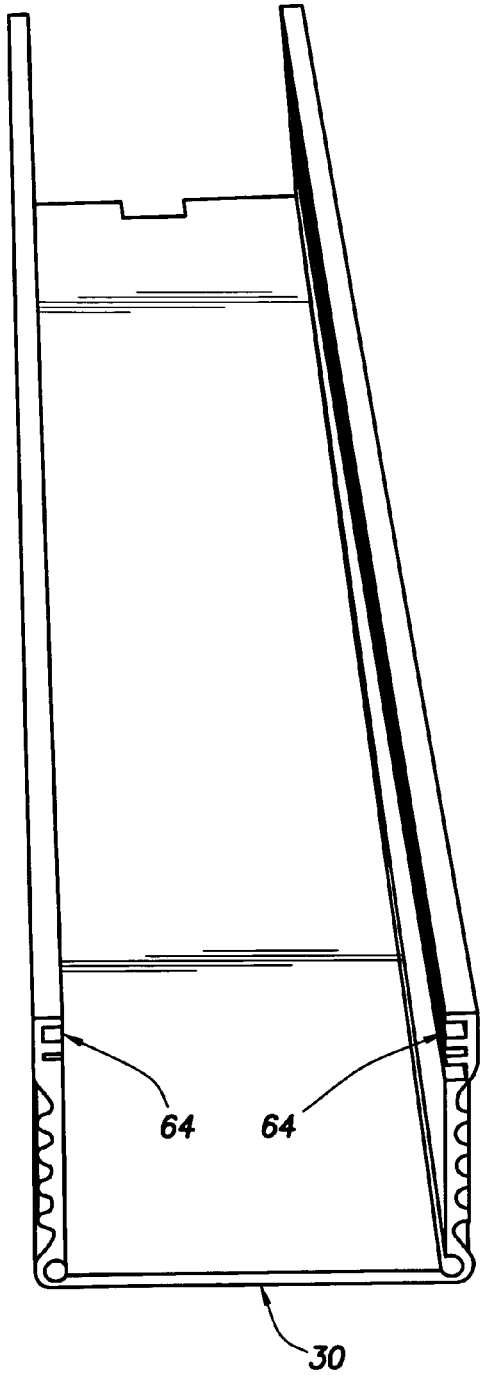
FIG. 9 is an end view of the housing box of FIG. 8.

FIG. 7 presents the component plate 32 detached from the component housing 14. The component plate serves as a mounting surface For the electrical components such as the ballast 66, switches such as power switch 36 and associated circuitry 68, power input and output socket 38 and 40 and associated circuitry 70, electrical connector 62 and associated wiring, dimmer controls, represented here by controls 42, and any associated circuitry, and various other wiring 71, as necessary and desired. In FIG. 9 and 10 are shown an alternate embodiment of a housing box 30 and component plate 32. Here the component plate 32 includes a computer board 72 and associated circuitry fur controlling aspects of the components and controls. Similarly, FIG. 11 shows an alternate arrangement including a computer board 72, dimmer circuitry 86, such as circuitry capable of converting digital signals to analog, and associated wiring. The component plate can include as many types of control and electrical components as desired. The analog and digital input and output sockets enable a series of component boxes, and their corresponding lighting, to be linked in a master-slave relationship, as will be understood by those skilled in the art. Further, the components need not necessarily be mounted to the plate 32, although this is the preferred embodiment for ease of access and replacement of electrical components.

The electrical components can run on any known voltage, such as at 120, 240 or 277 volts and adapters can be provided internally or externally, as desired. Alternately, the system can run at European standard 0.50 Hertz. Components, such as adaptors, can be supplied to allow flexibility in adapting to local power sources. For broadcast studio lighting assemblies, a change from one type of light to another can be accommodated by changing a module. The electrical ballast components can be instant start, rapid start or any variation. The ballast may be of various types as are available commercially. Different ballast manufacturers supply products with varying ballast wiring systems which can be accommodated. The ballast may be of various maximum THD, such as 2%, 10%, 20% or other maximum THD known in the industry.

Dimmer controls and circuitry may be provided. The dimmers can be analog, digital or voltage dimmers. Associated dimmer circuitry can be employed, such as digital to analog converters. An exemplary dimmer is a 10 volt analog voltage dimmer. Dimmer controls are known in the art and are commercially available.

As will be appreciated by those in the art, the various embodiments provide for easy detachment of the component housing, with the electrical, control and ballast components within, from the lamp housing. Providing lamp housings with similar or identical electrical wiring allows for interchanging component housings from one lamp housing to another. This allows ease of changing the lighting configuration to allow for various desired controls, such as dimming control, without replacement of the entire lighting assembly. Switching configurations can now be accomplished without changing the lamp housing, lamps and lampholders. Similarly, repair and replacement can now be accomplished easily and quickly, and by the non-professional. When any component in the component housing fails, the entire component housing can be removed and replaced by an interchangeable housing. The broken housing can be returned to the manufacturer or supplier for repair at a fraction of the shipping costs associated with returning the entire lighting assembly. Further, the need of on-site repair or replacement of electrical components is minimized or eliminated. Consideration of various wiring for different ballast brands can be taken care of within the component housing as well, rather than by an electrician on-site. Another advantage is that industrial and commercial users could plug in another component housing unit and essentially to make warranty repairs easier. The invention provides for a lighting assembly which allows for easily and quickly replacing broken or non-functioning electrical components, preferably without need for re-wiring of the lighting assembly on-site or shipment of the entire lighting assembly.

The embodiments shown and described above are only exemplary. Many details are often found in the art and are currently on the market and available to those in the trade. Therefore, many such details are neither shown nor described. Thus, it is not claimed that all of the details, parts, elements, or steps described and shown are invented herein. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of parts within the principles of the invention to the full extent indicated by the broad and general meaning of the terms used in the attached claims.

The restrictive description and drawings of the specific examples above do not point out what an infringement of this patent would be, but are to provide at least one explanation of how to make and use the inventions. The limit of the inventions and the bounds of the patent protection are measured by and defined in the following claims. Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments described in the specification.

Having described the invention, it is claimed:

1. A lighting assembly comprising: a lamp housing, with mountings for support and having a power supply mounting face, an opposed light providing face and right and left end faces, a lamp frame mounted to an interior of the lamp housing, at least one lamp socket mounted in the lamp frame for receiving at least one lamp, lamp wiring for supplying power to the at least one lamp, an electrical connector operably attached to the lamp wiring, the lamp housing having a mechanical connector on the power supply mounting face; and a separate, detachable power supply component housing having mounted therein electrical control components, electrical ballast and a power supply connector operable to releasably connect with the electrical connector of the lamp housing, the power supply component housing having a mechanical connector thereon operable for releasable attachment on the power supply mounting face.

2. The assembly of claim 1 wherein the electrical connectors are quick-snap connectors.

3. The assembly of claim 1 wherein the electrical connectors are nine-pin connectors.

4. The assembly of claim 1 wherein the mechanical connectors comprise a plurality of corresponding mountings.

5. The assembly of claim 4 wherein the corresponding mountings include a plurality of mating screw and nut assemblies.

6. The assembly of claim 1 wherein the electrical control components of the power supply component housing include dimmer controls and dimmer circuitry for selectively dimming at least one lamp in the lamp housing.

7. The assembly of claim 6 wherein the dimmer controls are analog dimmer controls.

8. The assembly of claim 6 wherein the dimmer controls are digital dimmer controls.

9. The assembly of claim 6 wherein the electrical control components of the power supply component housing include power controls for selectively supplying power to at least one lamp in the lamp housing.

10. The assembly of claim 6 wherein the electrical control components of the power supply components housing include a power output socket.

11. The assembly of claim 1 wherein the electrical control components of the power supply component housing include power controls for selectively supplying power to at least one lamp in the lamp housing.

12. The assembly of claim 1 wherein the electrical control components of the power supply component housing including a power output socket.

13. The assembly of claim 1 wherein the lamp housing includes two lamp sockets for receiving two lamps.

14. The assembly of claim 1 wherein the lamp housing includes at least one reflector.

15. The assembly of claim 1 wherein the lamp housing includes at least one lens.

16. The assembly of claim 1 wherein the lamp housing includes a housing mounting thereon for movably mounting the lamp housing.

17. The assembly of claim 1 wherein the power supply component housing includes a computer board.

18. The assembly of claim 1 wherein the power supply component housing comprises a component box and a component board, the component board having the electrical component mounted thereon, the component board removable from the component box.

19. The assembly of claim 18 wherein the component board is slidably attachable to the component box.

* * * * *